US010801222B2

(12) United States Patent
Nelson et al.

(10) Patent No.: US 10,801,222 B2
(45) Date of Patent: Oct. 13, 2020

(54) SEPARATELY OWNED WORKSHOPS WITH SHARED CENTRAL BUILDING

(71) Applicants: David L Nelson, Sunset Beach, NC (US); Jennifer Kelly Heine Clemmons, Sunset Beach, NC (US)

(72) Inventors: David L Nelson, Sunset Beach, NC (US); Jennifer Kelly Heine Clemmons, Sunset Beach, NC (US)

( * ) Notice: Subject to any disclaimer, the term of this patent is extended or adjusted under 35 U.S.C. 154(b) by 0 days.

(21) Appl. No.: 16/150,559

(22) Filed: Oct. 3, 2018

(65) Prior Publication Data

US 2019/0100932 A1 Apr. 4, 2019

Related U.S. Application Data

(60) Provisional application No. 62/567,273, filed on Oct. 3, 2017.

(51) Int. Cl.
*E04H 1/00* (2006.01)
*E04B 1/342* (2006.01)
*E04H 1/12* (2006.01)

(52) U.S. Cl.
CPC ..... *E04H 1/00* (2013.01); *E04B 1/342* (2013.01); *E04H 1/005* (2013.01); *E04H 1/1205* (2013.01)

(58) Field of Classification Search
CPC .. E04H 1/00; E04H 1/005; E04H 1/06; E04H 1/12; E04H 1/1205; E04H 1/1238; E04H 1/125; E04H 1/02; E04H 3/08; E04H 3/10; E04H 14/00; E04B 1/342; E04B 1/34861; E04B 1/34869
USPC ..... 52/79.1, 79.4, 169.1, 174, 234, 169.3
See application file for complete search history.

(56) References Cited

U.S. PATENT DOCUMENTS 3,874,137 A * 4/1975 Gentry ..... E04H 1/00 52/169.1
4,007,565 A * 2/1977 Finnegan ..... E04H 1/00 52/169.3
4,736,556 A * 4/1988 Scizak ..... E04H 1/005 52/169.2
4,800,692 A * 1/1989 Jenn ..... E04H 1/02 52/169.2
5,671,570 A * 9/1997 Kaufman ..... E04H 1/00 52/169.2
5,761,857 A * 6/1998 Kaufman ..... E04H 1/00 52/169.2
6,330,771 B1 * 12/2001 Hester, Jr. ..... E04H 3/08 52/106
6,651,393 B2 * 11/2003 Don ..... E04B 1/3483 52/124.2
6,688,052 B1 * 2/2004 Flanders ..... E04H 1/005 52/169.2
8,950,132 B2 * 2/2015 Collins ..... E04B 1/003 52/236.3

(Continued)

*Primary Examiner* — Brian E Glessner
*Assistant Examiner* — James J Buckle, Jr.
(74) *Attorney, Agent, or Firm* — Carla Gannon Law

(57) ABSTRACT

A workshop community includes a plurality of standalone workshop structures positioned around a central building. Each workshop within the community is individually owned, with workshop owners jointly owning the central building and associated infrastructure such a paths, fences and lights. Each workshop includes multiple doors, an individual electrical meter, parking, and gate access. The central building is the administrative and social hub of the workshop community.

1 Claim, 3 Drawing Sheets

(56) References Cited

U.S. PATENT DOCUMENTS

| | | | | |
|---|---|---|---|---|
| 9,222,273 | B2 * | 12/2015 | Webb | E04H 1/005 |
| 2007/0214733 | A1 * | 9/2007 | Braun | E04H 3/02<br>52/79.6 |
| 2009/0255195 | A1 * | 10/2009 | Bridgman | E04H 14/00<br>52/174 |
| 2013/0067832 | A1 * | 3/2013 | Collins | E04B 1/24<br>52/125.1 |
| 2016/0010883 | A1 * | 1/2016 | Jornitz | E03C 1/02<br>454/187 |

* cited by examiner

SEPARATELY OWNED WORKSHOPS WITH SHARED CENTRAL BUILDING

CROSS-REFERENCE TO RELATED APPLICATION

This application claims the priority of U.S. Provisional Patent Application Ser. No. 62/567,273, filed Oct. 3, 2017, which is hereby incorporated by reference in its entirety.

BACKGROUND OF THE INVENTION

The present invention relates to workshops in general, and more specifically, to a system and method of providing separately owned workshop spaces with shared access to a central building.

As more and more people are downsizing their living spaces upon retirement and/or becoming empty nesters, many are finding that space limitations prevent them from enjoying certain hobbies and activities. Additionally, many communities have HOA noise and/or aesthetic restrictions that prohibit certain activities that were conventionally conducted in the garage or on the driveway. Also, HOA restrictions often prohibit sheds or workshops on the property. Examples of activities that are not conducive to small space living include craft and/or building projects involving noisy power tools or large machinery; boat building; auto mechanics; welding and metal work; woodworking; pottery; ceramics; stained glass; mosaics; painting; sculpting; photography; video production; and band or musical instrument practice and/or recording. HOA restrictions also often prohibit self-storage of home or business items.

Rented storage units are helpful to some people insofar as they provide a place to store projects and materials, but storage units generally aren't conducive to practicing a hobby. Rather, renter's access is typically limited to moving possessions in and out, but not using the possessions on site. Indeed most storage units don't provide an electrical socket.

Shared workshop space is available in some communities, but has inherent limitations including privacy; hours of operation; rules and regulations regarding usage; and uncertainty regarding how long workshop space will remain available. Also, large projects can't be stored in shared workshops.

Rented commercial space overcomes some of the limitations of shared workshop space, but tends to be costly, is subject to lease modifications and termination by the landlord, and typically includes usage limitations. For example, many commercial properties do not allow access by anyone other than the lessee and business invitees, so even allowing a friend or family member access to the workshop without being accompanied by the lessee may be prohibited.

Another disadvantage of rented storage space, shared workshop space, and rented commercial space is that no equity is built. Rather, a renter may spend years and years paying for the privilege of use, but have no ownership interest.

Therefore, what is needed is a system and method of providing separately owned workshops with a shared central building. It is desirable that each workshop has electricity and that workshop owners have access to a central plumbed building for water and/or restroom needs. It is preferred that each individually deeded workshop has the potential of financially appreciating and building equity, and is freely transferable alone or in connection with the transfer of a different property.

SUMMARY OF THE INVENTIONS

The present invention is directed to a workshop community having a plurality of workshops and a central building all located on a single property, and surrounded by an access road. Each workshop is owned, while the central building and other infrastructure-related structures such as fencing, is commonly owned by all workshop owners. Each workshop preferably includes a standard sized front door, at least one large door positioned towards the access road, and a standard sized back door oriented towards the central building. Each workshop also preferably includes adjacent parking, a separate electricity meter, and gate access. The workshop community may have a specific design theme that socially and visually integrates the central building with the individual workshops.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The following structure numbers shall apply to the following structures among the various FIGS.:

10—workshop community;
12—light;
15—property;
16—gate;
17—main road;
18—access road;
19—fence;
20—workshop;
  20*a*—corner workshop;
  20*b*—inner workshop;
21—front door;
22—large door;
23—parking;
25—electrical meter;
27—back door;
30—central building;
40—front side;
45—back side; and
50—linear path.

Broadly, the present invention pertains to real estate developments and business methods, and more particularly to separately owned workshops with a shared central building.

Figure 1:
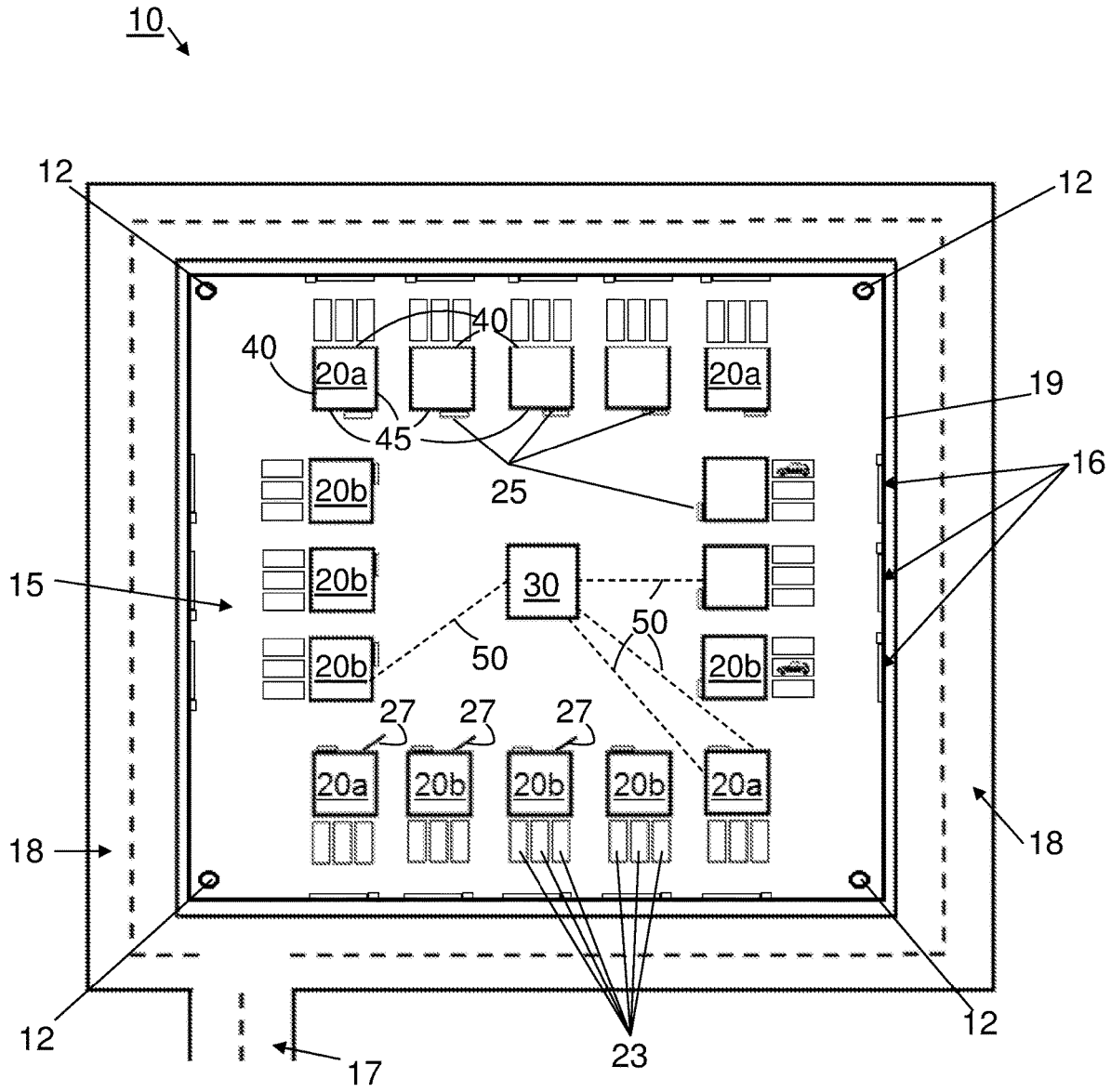
FIG. 1 is a plan view of a workshop community.

FIG. 1 depicts workshop community 10 on property 15 surrounded by access road 18. It is preferred that access road 18 is along entire perimeter of workshop community 10 so that vehicles and people can easily access each individual workshop 20. Parking 23 is preferably positioned adjacent to each workshop 20 and easily accessed by access road 18. Main road 17 is preferably in communication with access road 18. In a preferred embodiment, fence 19 surrounds outside perimeter of properties 15, with gates 16 providing access to each property. Gates 16 are preferably security gates with key pads for entry. A plurality of lights 12 provide additional security and safety.

Workshop community 10 is preferably laid out with workshops 20 generally forming a perimeter around central building 30 such that there is an unimpeded path between back door 27 and central building 30. If back door 27 isn't present there should be an unimpeded path between back side of workshop 20 and central building 30. Path between workshop 20 and central building 30 can be improved, such as by a sidewalk, or unimproved land.

Figure 2:
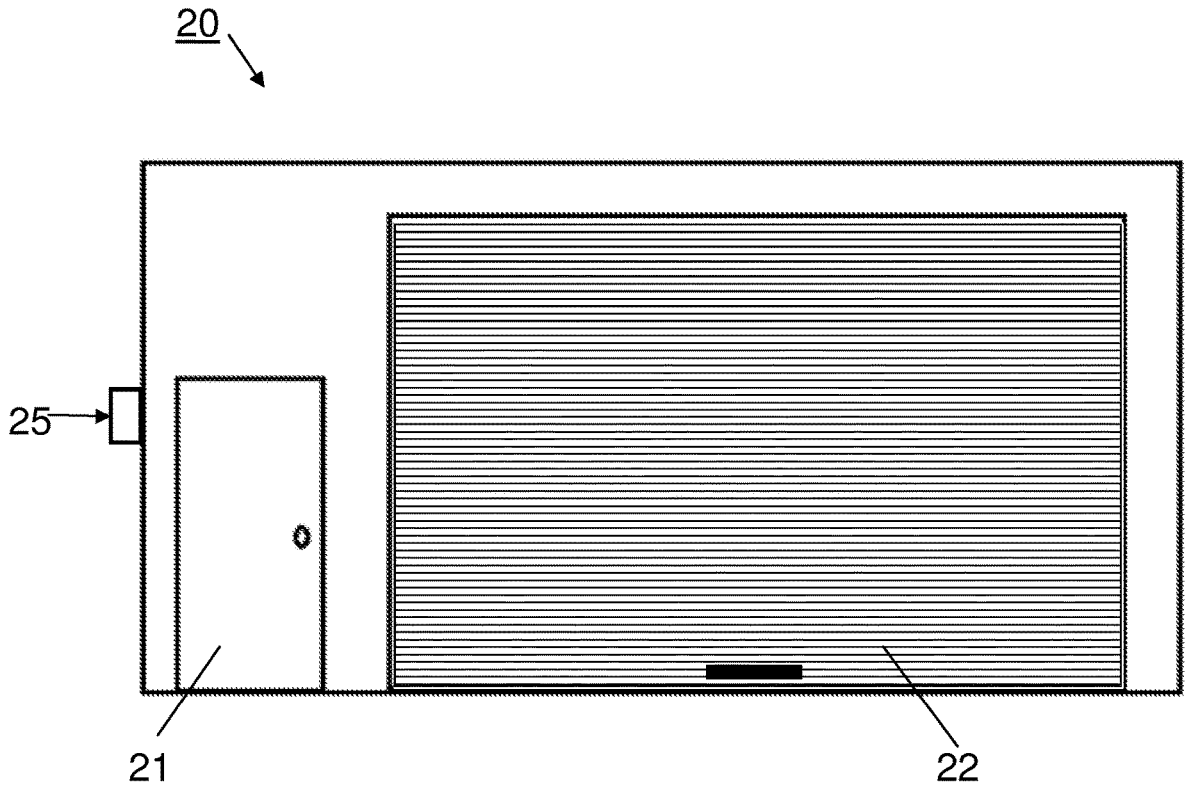
FIG. 2 is the exterior view of a single workshop with a single door.
Figure 3:
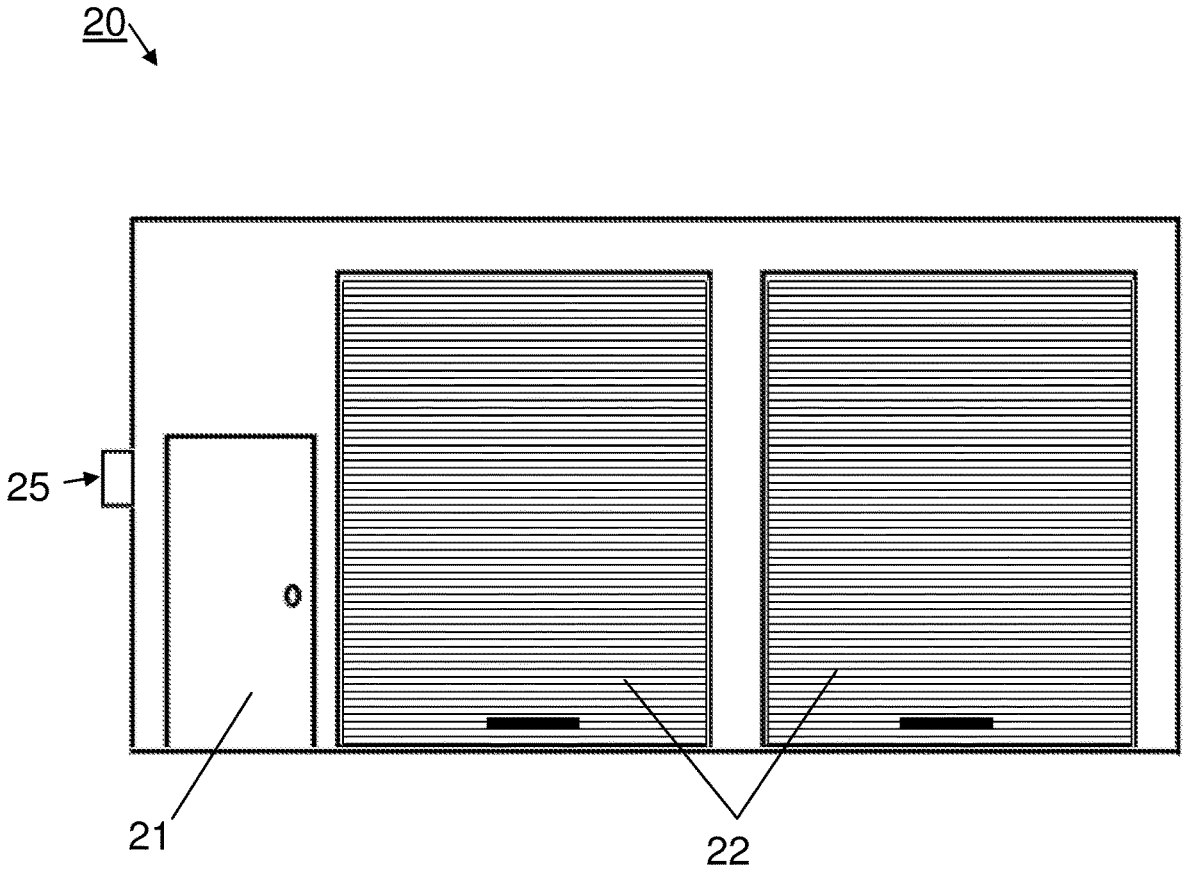
FIG. 3 is the exterior view of a single workshop with double doors.

In a preferred embodiment each workshop 20 is a standalone metal building structure including front door 21, back door 27, and one or two large doors 22, as shown in FIGS. 2 and 3, respectively. Buildings may be commercially available 24'×40' structures, although different sizes and shapes can be employed. Each building structure is preferably built upon a separate concrete slab, and not touching adjacent workshops.

In one embodiment the layout of workshop community 10 is a four-sided perimeter having an equal number of workshops 20 on each side, with a total of 14 workshops: four corner workshops 20*a* and 10 inner workshops 20*b*. The layout can vary based on the specific property and land, but should maximize land space to keep cost low, allow easy ingress and egress, ensure that each workshop is reasonably close to central building, and provide a flow that facilitates interactions and relationships between owners.

Each workshop 20 is privately owned and transferred by a legal instrument such as a deed in accordance with standard real estate property laws, with shared ownership of central building 30. This arrangement is legally equivalent to condominium ownership wherein owners each individually own their unit, and have a shared interest in common areas such as a parking lot, pool and lobby. Ownership interest preferably includes voting rights, similar to Home Owners' Associations and the like, for purposes of determining management of facilities, repair of infrastructure, enforcement of rules, and so forth. In a preferred embodiment every owner is responsible for maintenance of their workshop 20 and property 15, but central building 30 and shared infrastructure such as fence 19 is maintained by all owners. It is preferred that each workshop 20 includes its own electrical meter 25, but doesn't include plumbing so as to avoid zoning and tax issues associated with plumbed structures.

Ownership interest in workshop community 10 may be freely transferrable, or may be linked to the ownership and sale of other property. An example of the latter is a housing development that offers workshop community ownership as a purchasable amenity of home ownership in the development, subject to the limitation that subsequent transfer of the workshop must be to another housing development home owner. This is similar to the transfer of a golf membership in a housing development that owns a private golf course.

Central building 30 preferably includes running water and restrooms. A variety of facilities and functions can also be housed in central building 30 such as owner's lounge, vending machines, administrative and/or security offices, tool lending library, first aid supplies, mail boxes, and so forth.

In one embodiment a plurality of workshop communities are developed by a common entity, with each workshop community 10 having a distinct style theme. For example, one workshop community may have a "50's" theme with a vintage gas station style central building that includes a decorative old gas pump, 50's signage, piped-in oldies, and a milk shake fountain in the central building. Another workshop community may have a "vintage airplane" theme with a hangar style central building, old bi-plane memorabilia, and decorative aviation items like propellers, flight seats, and so forth.

Referring to FIG. 2, each workshop 20 preferably includes front door 21 for ingress and egress of owners and guests, and large door 22 for ingress and egress of large items such as materials, machinery, vehicles, and so forth. As shown in FIG. 3, workshop 20 can include two large doors 22, or even more, instead of one.

The separately owned workshops with shared central building is also a business method wherein a developer obtains property 15, builds access road 18 around perimeter of property, erects a plurality of workshops 20 adjacent to access road, constructs central building within perimeter, and sells individual workshops to owners.

Certain structures and components are disclosed for purposes of describing an embodiment, and setting forth the best mode, but should not be construed as teaching the only possible embodiment. Rather, modifications may be made without departing from the spirit and scope of the invention as set forth in the following claims. Examples of modifications include a variety of themes such as outer space, or vintage outdoor adventure themes including workshops large enough to provide storage for RV's, motor homes, boats, and/or personal marine watercraft, and so forth. It should be understood that all specifications, unless otherwise stated or contrary to common sense, are +/−10%, and that ranges of values set forth inherently include those values, as well as all increments between. Also, "substantially" as used herein, shall mean generally. By way of example a "substantially planar" surface includes surface imperfections but is generally planar.

What is claimed is:

1. A workshop community including:

A. a plurality of standalone workshops forming a perimeter having exactly four corners and exactly one strata around a central building, each of said workshops including at least one back side oriented inward relative to said perimeter, and each of said workshops including at least one front side oriented outward of said perimeter including a large door suitable for ingress and egress of vehicles;

B. a separate concrete slab positioned under each workshop;

C. a fence completely surrounding said perimeter, said fence substantially parallel to said front sides;

D. a plurality of gates engaged with said fence, exactly one of each said gates adjacent to exactly one of each said workshops, each of said gates including a key pad for entry;

E. exactly one access road directly and completely surrounding said fence wherein each large door is directly accessed by said access road without bypassing another said workshop;

F. a plurality of parking areas each corresponding with one of said workshops, each of said parking areas positioned between said at least one front side and one of said gates; and G. a plurality of electrical meters each individually connected to each workshop, wherein each of said workshops are owned by individual owners, and said central building is jointly owned by all individual owners, and wherein at least one unobstructed linear path exists between each of said at least one back side and said central building.

* * * * *